US005946949A

United States Patent [19]

Park et al.

[11] Patent Number: 5,946,949

[45] Date of Patent: Sep. 7, 1999

[54] CLOTHES WASHING MACHINE HAVING A WATER-EJECTING PULSATOR

[75] Inventors: Jae-Ryoung Park, Suwon; Min-Su Cho, Inchun; Kyoung-Weon Park, Seoul; Young-Chul Kim, Suwon, all of Rep. of Korea

[73] Assignee: Samsung Electronics Co., Ltd., Suwon, Rep. of Korea

[21] Appl. No.: 09/050,131

[22] Filed: Mar. 30, 1998

[30] Foreign Application Priority Data

| | | | |
|---|---|---|---|
| Jun. 30, 1997 | [KR] | Rep. of Korea | 97-28998 |
| Jun. 30, 1997 | [KR] | Rep. of Korea | 97-29002 |
| Jun. 30, 1997 | [KR] | Rep. of Korea | 97-29005 |
| Jun. 30, 1997 | [KR] | Rep. of Korea | 97-29009 |

[51] Int. Cl.[6] ..... D06F 17/10

[52] U.S. Cl. ..... 68/53; 68/134

[58] Field of Search ..... 68/53, 134

[56] References Cited

U.S. PATENT DOCUMENTS

| | | | |
|---|---|---|---|
| 4,420,952 | 12/1983 | Brenner et al. | 68/53 |
| 5,829,276 | 11/1998 | Suh et al. | 68/53 |

FOREIGN PATENT DOCUMENTS

| | | | |
|---|---|---|---|
| 229276 | 10/1996 | Japan | 68/53 |

*Primary Examiner*—Philip R. Coe
*Attorney, Agent, or Firm*—Burns, Doane, Swecker & Mathis, L.L.P.

[57] ABSTRACT

A clothes washing machine has a pulsator and a spurting apparatus for spurting washing water upwardly from the center of the pulsator, so as to disperse laundry gathered thereabove. The spurting apparatus has at least one guide duct and a spurt cap. The guide duct is fixed to an underside of the pulsator so as to rotate together with the pulsator. The washing water is introduced into a radially outer end of the guide duct and guided toward the center of the pulsator. The spurt cap disposed at the center of the pulsator guides the washing water upwardly.

12 Claims, 7 Drawing Sheets

CLOTHES WASHING MACHINE HAVING A WATER-EJECTING PULSATOR

BACKGROUND OF THE INVENTION

1) Field of the Invention

The present invention relates to a clothes washing machine, and more particularly to a washing machine having a spin basket in which a pulsator is mounted for rotation.

2) Prior Art

Generally, a clothes washing machine is an appliance for washing laundry, in which a pulsator rotates to generate washing current for applying impact to the laundry, thereby washing the laundry.

FIG. 1 shows such a conventional washing machine. As shown, the conventional washing machine includes a housing 10 forming the outer appearance of the washing machine, a tub 11 installed in the housing 10 for containing a predetermined amount of washing water required for washing the laundry, and a spin basket 12 rotatably installed in the tub 11. A pulsator 13 for generating the washing current is mounted on the inner bottom of the spin basket 12, and a driving mechanism 14 for driving the spin basket 12 and the pulsator 13 is arranged under the tub 11. The driving mechanism 14 includes a motor 14*a* and a transmission 14*b*. The motor 14*a* generates the driving power, and the transmission 14*b* selectively drives the pulsator 13 and the spin basket 12 by means of the rotating force of the motor 14*a* transferred through a belt 14*c*.

Further, a drain hose 15 is provided at one side position under the tub 11 and extends out of the housing 10 to drain the washing water from the tub 11.

In the conventional washing machine as constructed above, when an electric power is applied after the laundry is put in the spin basket 12, the washing water is supplied into the spin basket 12 and then the pulsator 13 is rotated in one direction or alternately in opposite directions (i.e., oscillated) by the motor 14*a* to generate the washing current. The laundry flows according to the washing current and is washed by the friction occurring between the clothes and the washing water and the inner wall of the spin basket 12.

However, in such a conventional washing machine, the laundry usually becomes tangled together above the center of the pulsator to thereby diminish the washing performance. That is, the centrifugal force caused by the rotation of the pulsator drives the washing water toward the wall of the spin basket. As a result, the washing water is deeper at the outer periphery of the pulsator, than at the center thereof. Therefore, the clothes come into closer contact above the center of the pulsator. Such gathered laundry above the center of the pulsator goes on rotating in one direction or alternately in opposite directions along with the pulsator, so that the laundry becomes severely tangled together, thereby diminishing the washing performance of the washing machine and even damaging the laundry.

SUMMARY OF THE INVENTION

The present invention has been made to overcome the above described problems of the prior art, and accordingly it is an object of the present invention to provide a washing machine, in which washing water spurts upwardly from the center of a pulsator, so as to disperse the laundry gathered thereabove.

To achieve the above object, the present invention provides a washing machine comprising:

a housing;

a spin basket mounted in the housing;

a pulsator rotatably mounted at a bottom of the spin basket for agitating washing water therein; and a washing water spurting apparatus for conducting washing water from beneath the pulsator and spurting the washing water upwardly from a center region of the pulsator.

The washing water spurting apparatus preferably includes at least one guide duct and a spurt cap, the guide duct being fixed to a lower surface of the pulsator so as to rotate together with the pulsator, the washing water introduced into the guide duct being guided toward the center region of the pulsator by the guide duct, the spurt cap being disposed at the center region of the pulsator, so as to direct the spurting washing water upwardly.

BRIEF DESCRIPTION OF THE DRAWINGS

The above object, and other features and advantages of the present invention will become more apparent by describing preferred embodiments thereof in detail with reference to the attached drawings, in which.

DESCRIPTION OF THE PREFERRED EMBODIMENT

Hereinafter, a preferred embodiment of the present invention will be described in detail with reference to the accompanying drawings, and like elements will be numbered the same in the following description.

Figure 1:
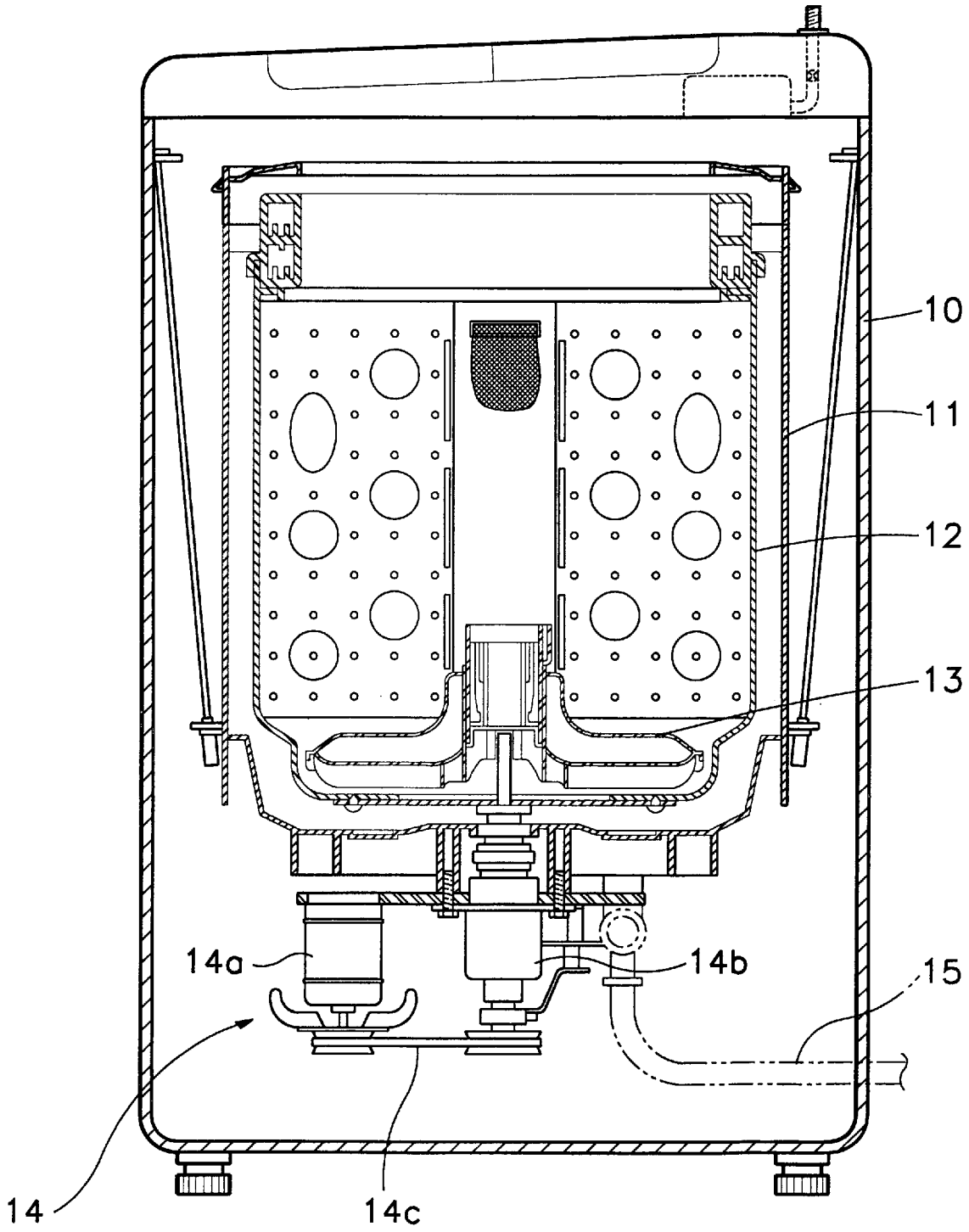
FIG. 1 (PRIOR ART)
FIG. 1 is a sectional view of a conventional washing machine for showing the inner construction thereof.
Figure 2:
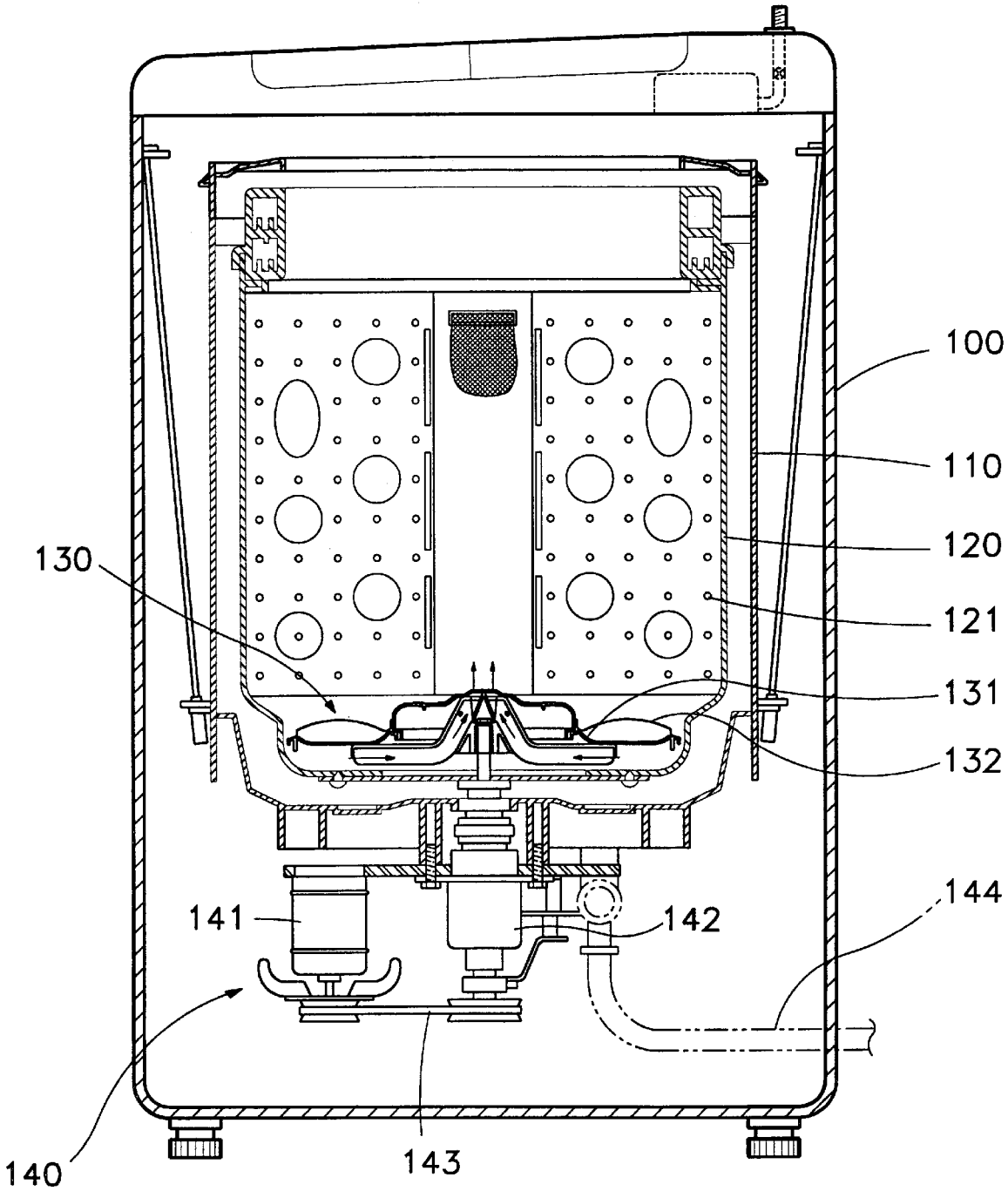
FIG. 2 is a sectional view of a washing machine according to an embodiment of the present invention, which shows the inner construction thereof.

FIG. 2 is a sectional view of a preferred embodiment of a washing machine according to the present invention, for showing the inner construction thereof.

As shown, the washing machine according to the present invention has a housing 100 forming the outer appearance of the washing machine. A control section (not shown) is arranged in an upper portion of the housing 100, and a tub 110 for containing the washing water is mounted in the housing 100. A spin basket 120 formed with a plurality of holes 121 is rotatably installed in the tub 110. On the bottom of the spin basket 120 is installed a pulsator 130 which includes a rotating plate 131 carrying a plurality of blades 132 arranged radially and protruding upward from the upper surface of the rotating plate 131. The pulsator 130 generates the washing current when it rotates in one direction or alternately is oscillated in opposite directions.

A driving mechanism 140 for driving the spin basket 120 and the pulsator 130 is arranged under the tub 110. The driving mechanism 140 includes a motor 141 and a transmission 142. The motor 141 produces the driving power, and the transmission 142 selectively rotates the pulsator 130 and the spin basket 120 by means of the rotating force of the motor 141 transferred through a belt 143. The transmission 142 rotates either the pulsator 130 alone, when the laundry is being washed, or it rotates the spin basket 120 and the pulsator 130 together when the laundry is being dehydrated (spin-drying). A drain hose 144 is provided at one side position under the tub 110 and extends out of the housing 100 to drain the washing water from the tub 110.

The pulsator 130 further includes a washing water spurting apparatus for spurting (ejecting) the washing water upwardly from the center of the pulsator to thereby prevent the laundry from being gathered and tangled, which apparatus is a characteristic element of the present invention.

Figure 3:
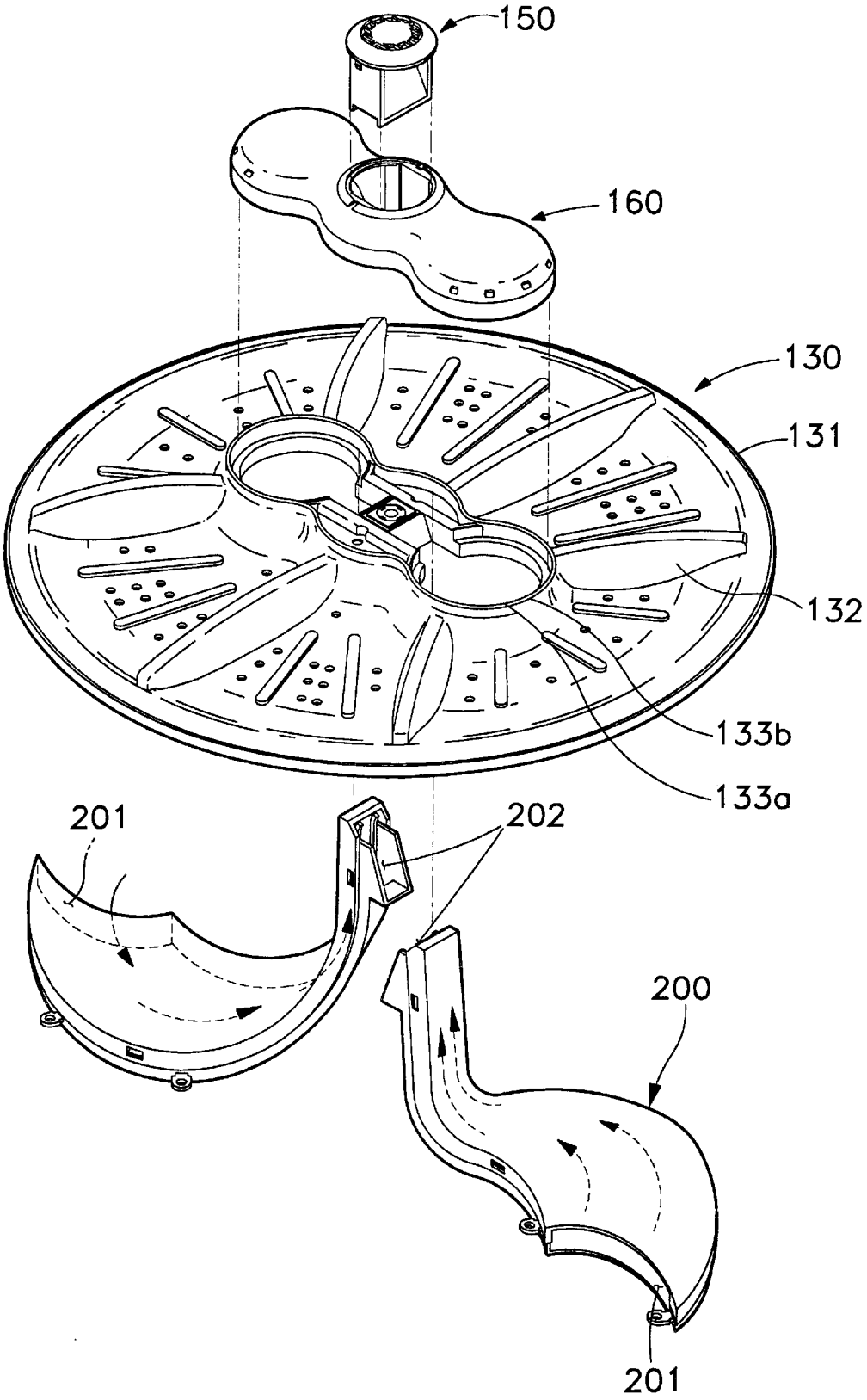
FIG. 3 is an exploded perspective view of a pulsator and a washing water spurting apparatus installed to the pulsator, which are employed in the washing machine shown in FIG. 2.

FIG. 3 is an exploded perspective view for showing in detail the construction of the pulsator and the washing water spurting apparatus according to the present invention.

The washing water spurting apparatus includes a guide duct 200 and a spurt cap 150. The guide duct 200 is fixed to the underside of the pulsator 130 so as to rotate together with the pulsator 130, thereby receiving washing water and guiding the washing water to the center of the pulsator 130. The spurt cap 150 is disposed at the center of the pulsator 130, so as to upwardly direct the washing water, guided by the guide duct 200, to a location above the center of the pulsator 130.

Although the washing water spurting apparatus may include only one guide duct 200, it is preferable to provide a pair of guide ducts 200 fixed to the pulsator 130 in opposing relationship to each other, in consideration of the space available for locating the guide ducts 200 and the need to keep the pulsator 130 dynamically balanced.

Each guide duct 200 has an inlet 201 formed at a radially outer end thereof and an outlet 202 formed at a radially inner end thereof. When the pulsator 130 rotates, the washing water is caused to enter the guide duct 200 through the inlet 201, and exit the guide duct 200 through the outlet 202 in an upward direction at the center of the pulsator 130. The cross sectional area of the guide duct 200 gradually decreases from the inlet 201 to the outlet 202, so that the flowing speed of the washing water increases as it goes from the inlet 201 to the outlet 202, whereby a strong upward spurt of the washing water occurs at the outlet 202. Further, the inlet 201 of the guide duct 200 faces in a horizontal direction, while the outlet 202 thereof faces upwardly.

In the meantime, in order to disperse the laundry gathered above the center of the pulsator 130 during a washing operation, the spurting force of the washing water from the guide duct 200 should be maximized. To achieve this, the length of the guide duct 200 must be long enough. That is, the traveling distance of the washing water in the guide duct 200 must be long enough to maximize the water speed. In other words, since the washing water flows faster as it goes from the inlet 201 to the narrower outlet 202 as described above, not only must a sufficient amount of the washing water be contained in the guide duct 200, but also the washing water must experience a sufficient length of flow, in order to get a highly increased spurting speed of the washing water. In order to fulfill this condition, it is preferred that the length of the guide duct 200 or the flowing distance of the washing water in the guide duct 200 be longer than the radius of the pulsator 130.

The spurt cap 150 and a supplementary blade 160 are arranged at the center of the pulsator 130. The spurt cap 150 guides the washing water spurting out of the outlet 202 of the guide duct 200 directly upward from the center of the pulsator 130. The spurt cap 150 is assembled to the supplementary blade 160 which rotates concurrently with the pulsator 130 to make the vortex of the water current more violent.

Figures 4, 4A:
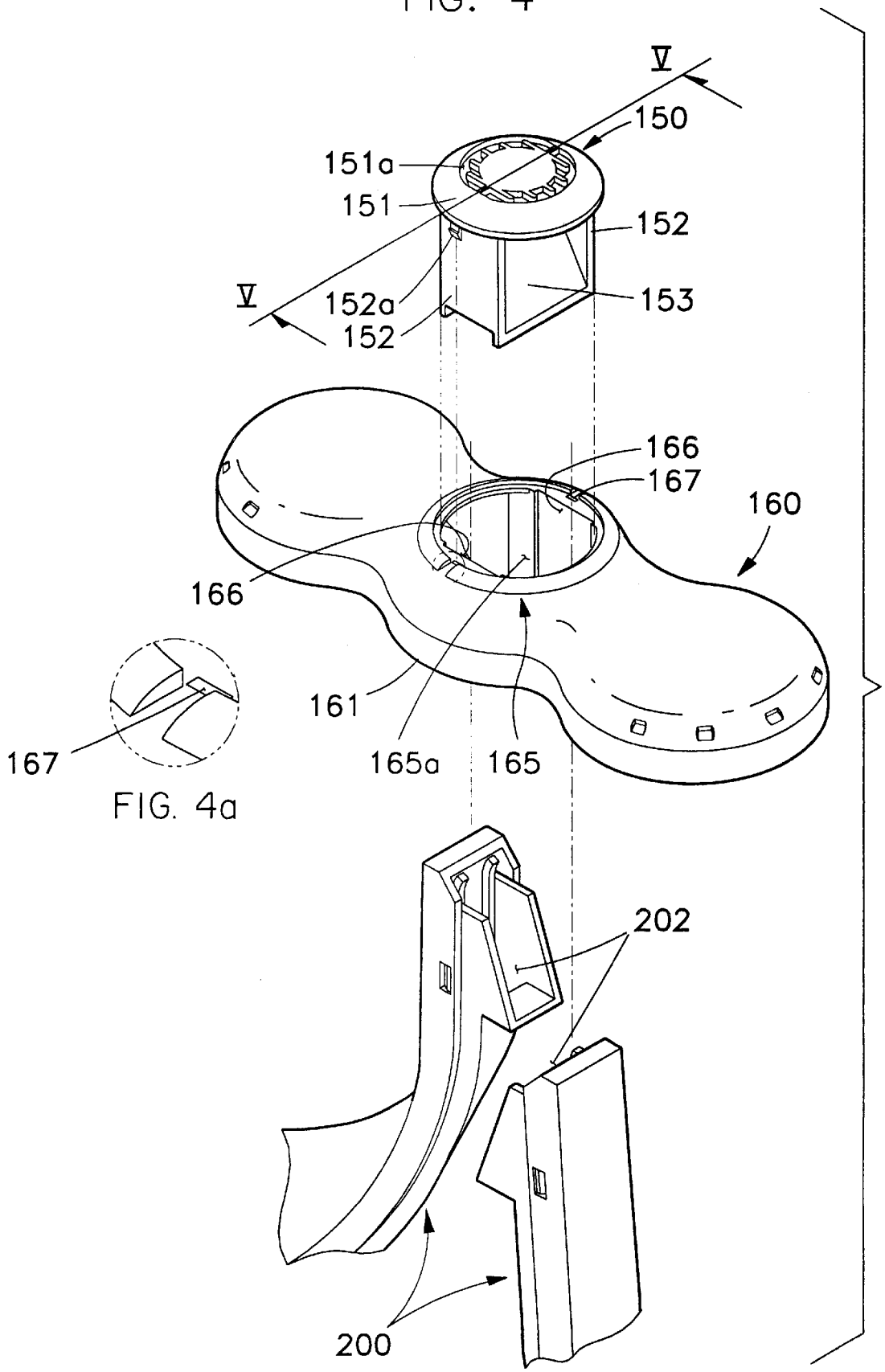
FIG. 4 is an enlarged exploded perspective view of a supplementary blade and a spurt cap shown in FIG. 3.
FIG. 4*a* is an enlarged view of an encircled portion of FIG. 4.
Figure 5:
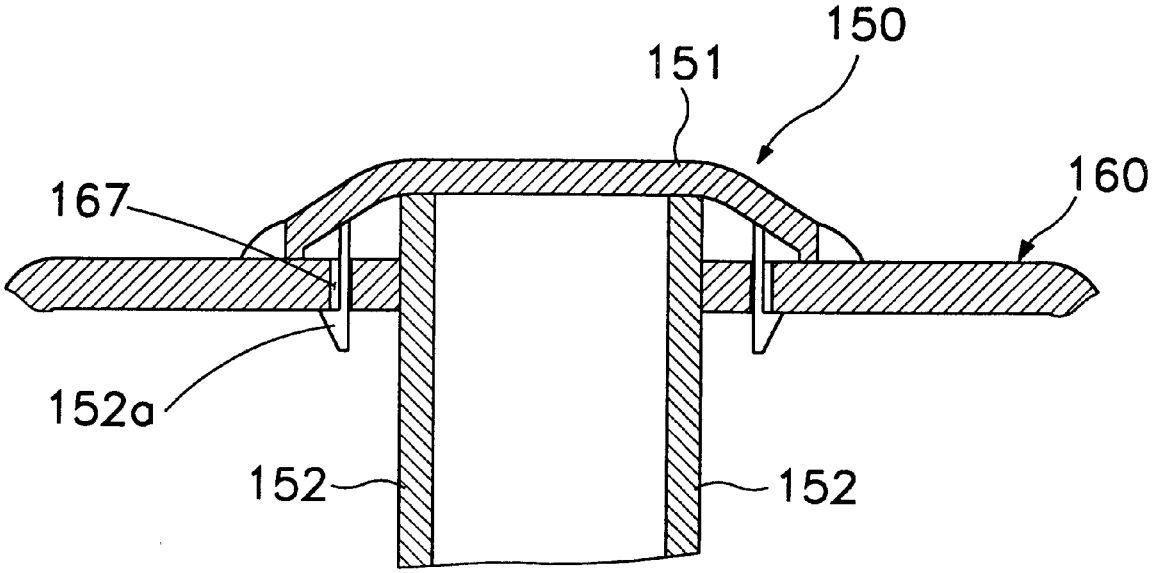
FIG. 5 is a sectional view of the spurt cap, taken along line V—V in FIG. 4.
Figure 6:
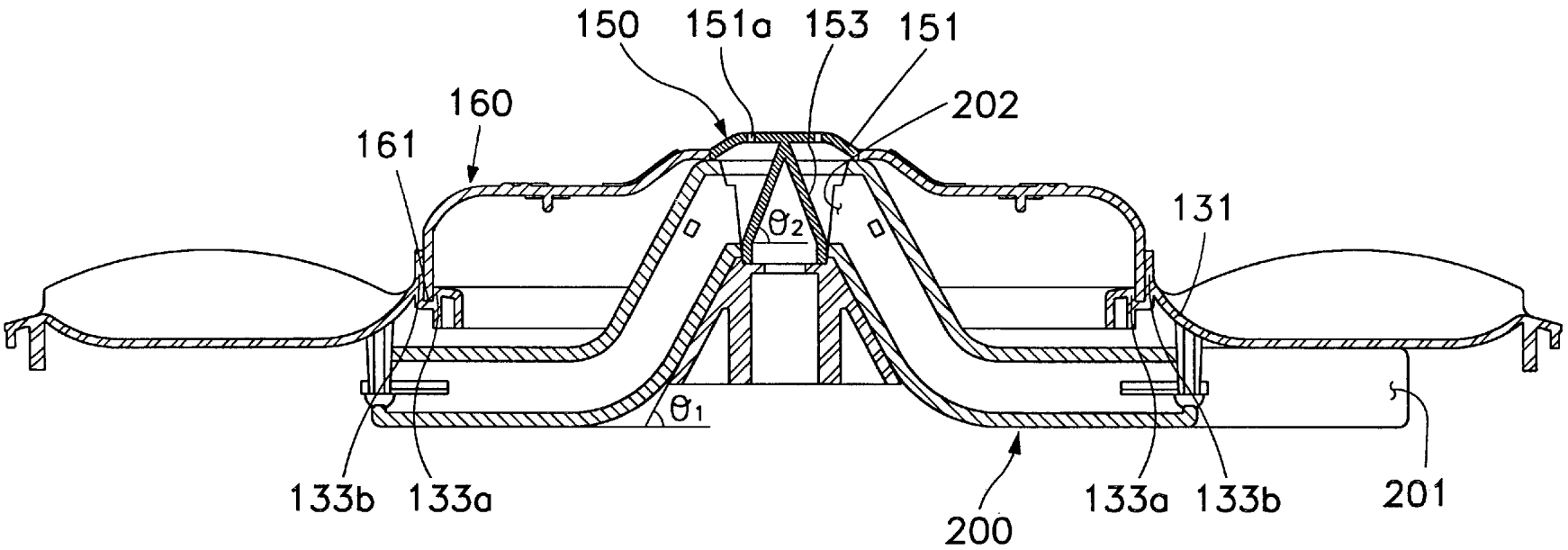
FIG. 6 is a sectional view of the pulsator and the washing water spurting apparatus of FIG. 3, in a state that they are assembled with each other.

FIG. 4 is an enlarged exploded perspective view of the supplementary blade and the spurt cap shown in FIG. 3; FIG. 5 is a sectional view of the spurt cap, taken along line V—V in FIG. 4; and FIG. 6 is a sectional view of the pulsator and the washing water spurting apparatus of FIG. 3, in a state that they are assembled with each other. Hereunder, the assembling construction of the spurt cap 150 and the supplementary blade 160 with the pulsator 130 will be described, with reference to FIGS. 4 to 6.

A pair of flanges 133*a* and 133*b* are arranged at the center of the pulsator 130 (see FIG. 6). The flanges 133*a* and 133*b* are spaced apart from each other to form a gap therebetween having a thickness corresponding to that of a lower rim 161 of the supplementary blade 160. The lower rim 161 of the supplementary blade 160 is inserted in the gap formed between the flanges 133*a* and 133*b*, so that the supplementary blade 160 is assembled with the pulsator 130. At the center of the supplementary blade 160 there is arranged a seat 165 in which a circular space 165*a* is formed. The spurt cap 150 is inserted into the space 165*a*. The space 165*a* interconnects the outlets 202 of the guide ducts 200 to the spurt cap 150.

The spurt cap 150 includes a spurt plate 151 and a pair of side plates 152. The spurt plate 151 is disc-shaped and is formed with a plurality of vertical spurt holes 151*a*. The side plates 152 extend downwardly from the spurt plate 151 and are diametrically opposed to each other. A pair of inclined guide plates 153 is disposed between the side plates 152 to support the side plates 152 and guide the washing water flowing out of the outlets 202 of respective guide ducts 200 toward the spurt holes 151*a*. Outside of each side plate 152 there is provided a plurality of assembling protuberances 152*a* extending downwardly from the lower surface of the spurt plate 151.

In the meantime, in a cylindrical wall forming the space 165*a* there are formed vertical assembling guide grooves 166 into which respective side plates 152 of the spurt cap 150 are inserted. Receiving holes 167 are formed in the seat 165 at locations corresponding to the assembling protuberances 152*a* of the spurt cap 150. Therefore, as shown in FIG. 5, when the side plates 152 are inserted into respective the assembling guide grooves 166 of the space 165*a*, the assembling protuberances 152*a* are received in the respective receiving holes 167 of the seat 165, so that the spurt cap 150 is firmly assembled with the supplementary blade 160.

With the spurt cap 150 assembled with the supplementary blade 160 as described above, the spurt holes 151*a* of the spurt cap 150 are interconnected to the outlets 202 of the guide ducts 200, and the guide plate 153 can guide the washing water from the guide ducts 200 precisely to the spurt holes 151*a*. Therefore, the washing water in the guide ducts 200 is spurted precisely upwardly from the center of the pulsator 130.

In this case, the washing water can be smoothly spurted when each guide plate 153 of the spurt cap 150 is inclined at the same angle as the inclination of the outlet 202 of the respective guide duct 200. In other words, if the inclination angle $\Theta_2$ of the guide plate 153 shown in FIG. 6 were larger than the inclination angle $\Theta_1$ of the outlet 202, the guide plate 153 would resist the flow of the washing water. On the contrary, if the inclination angle $\Theta_2$ of the guide plate 153 shown in FIG. 6 were smaller than the inclination angle $\Theta_1$ of the outlet 202, the spurting force of the washing water would be decreased. Therefore, the guide plate 153 and the outlet 202 of the guide duct 200 are preferably inclined at the same angle to achieve a maximum spurting force.

Figure 7:
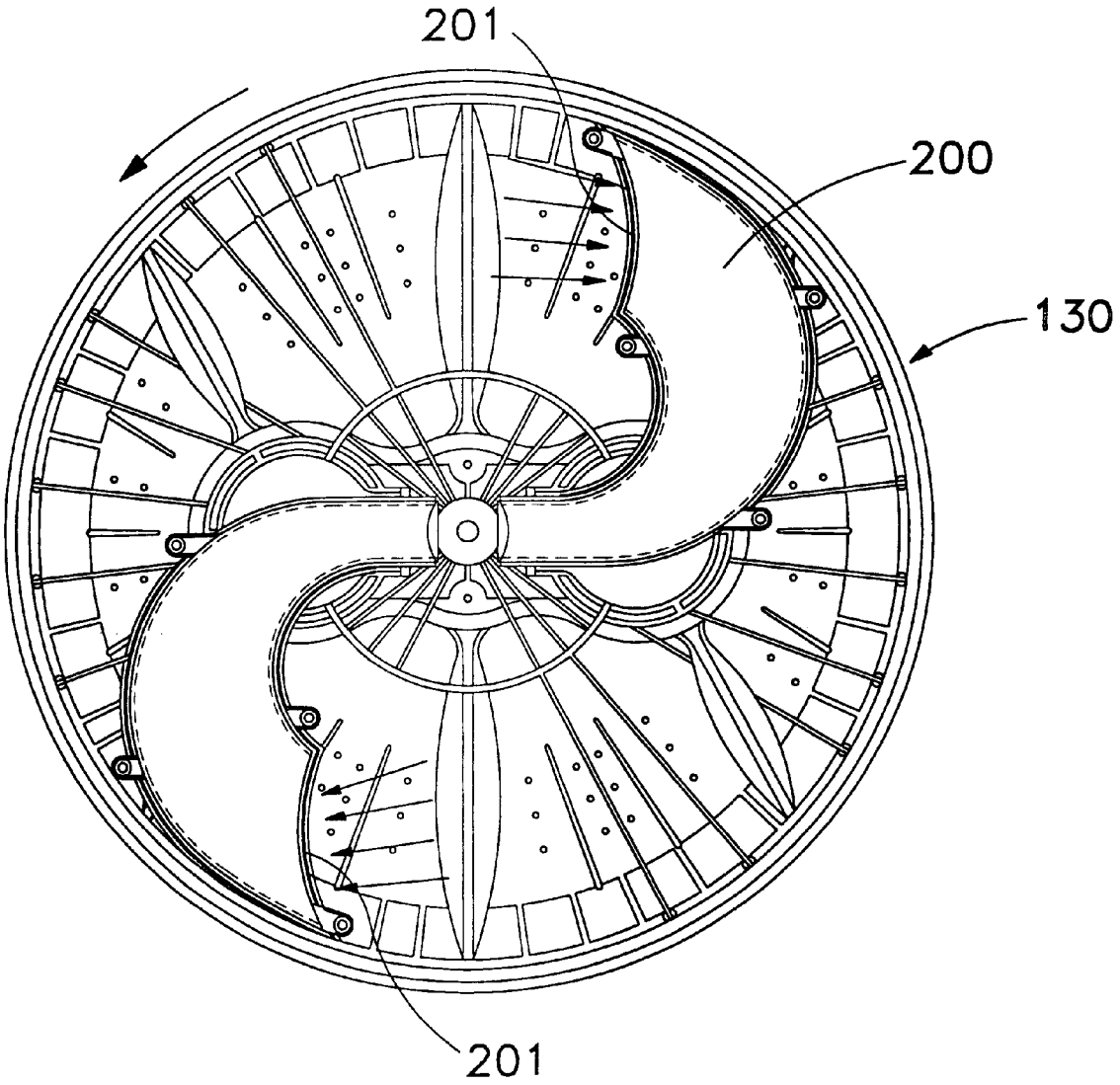
FIG. 7 is a bottom view of the pulsator and the washing water spurting apparatus of FIG. 3, in a state that they are assembled with each other.

FIG. 7 is a bottom view of the pulsator and the washing water spurting apparatus of FIG. 3, in a state that they are assembled with each other. Referring to FIGS. 2 and 7, the operation of the washing machine according to the present invention will be described hereinafter.

First, when the washing machine is driven by operating the control section (not shown) after putting the laundry in the spin basket 120, the washing water is introduced into the spin basket 120 and simultaneously enters the guide ducts 200. Thereafter, an electric power is applied to the motor 141, whereupon the transmission 142 rotates the pulsator 130 in one direction, or alternately oscillates the pulsator in opposite directions, by means of the rotational force transferred from the motor 141. In this case, the guide ducts 200 fixed to the lower surface of the pulsator 130 rotate together with the pulsator 130. When the pulsator 130 rotates counterclockwise as shown in FIG. 7, the washing water continuously flows into the guide ducts 200 through the inlet 201. The washing water introduced into the guide ducts 200 as described above continues flowing in the guide ducts 200 and then spurts upwardly from the center of the pulsator 130 through the outlet 202. In the meantime, as described above, since the cross sectional area of each guide duct 200 narrows from the inlet 201 to the outlet 202, the washing water flows gradually faster to eventually achieve a strong spurt through the outlet 202 and the spurt cap 150. Therefore, the laundry gathered above the center of the pulsator 130 during the washing can be dispersed by the strong spurt of the washing water.

As described above, the washing machine according to the present invention includes a washing water spurting apparatus for guiding and spurting the washing water upward from the center of the pulsator. The washing water spurting apparatus disperses the laundry gathered above the center of the pulsator to thereby prevent the laundry from being tangled and damaged, and at the same time the spurting washing water applies an impact to the laundry to thereby improve the washing performance of the washing machine.

While the present invention has been particularly shown and described with reference to the particular embodiment thereof, it will be understood by those skilled in the art that various changes in form and details may be effected therein without departing from the spirit and scope of the invention as defined by the appended claims.

What is claimed is:

1. A clothes washing machine comprising:

a housing;

a spin basket mounted in the housing;

a pulsator rotatably mounted at a bottom of the spin basket for agitating washing water therein; and a washing water spurting apparatus for conducting washing water from beneath the pulsator and spurting the washing water upwardly from a center region of the pulsator, the washing water spurting apparatus comprising at least one guide duct and a spurt cap, the guide duct being fixed to an underside of the pulsator so as to rotate together with the pulsator, the guide duct receiving and guiding washing water introduced toward the center region of the pulsator, the spurt cap being disposed at the center region of the pulsator, so as to upwardly direct the washing water spurting from the guide duct, the guide duct having an inlet formed at a radially outer end of the guide duct and an outlet formed at a radially inner end of the guide duct, the outlet situated substantially below an upper end of the spin basket, the washing water flowing into the guide duct through the inlet and spurting out of the guide duct and into the spin basket through the outlet, the guide duct having a cross sectional area gradually decreasing from adjacent the inlet to adjacent the outlet.

2. The clothes washing machine as claimed in claim 1, wherein the washing water spurting apparatus comprises a pair of the guide ducts fixed to the pulsator at diametrically opposed positions.

3. The clothes washing machine as claimed in claim 1, wherein the inlet of the guide duct faces horizontally, and a radially inner portion of the guide duct is bent upwardly so that the outlet protrudes above the pulsator.

4. The clothes washing machine as claimed in claim 3, wherein the guide duct is arranged to have such a length that a flowing distance of the washing water in the guide duct is longer than a radius of the pulsator.

5. The clothes washing machine as claimed in claim 1, wherein the spurt cap comprises a spurt plate, a pair of side plates, a pair of guide plates, and a plurality of assembling protuberances, the spurt plate being disc-shaped and formed with a plurality of vertical spurt holes, the side plates extending downwardly from the spurt plate and being diametrically opposed to each other, the guide plates being disposed between the side plates to support the side plates and inclined obliquely relative to vertical to guide the washing water from the outlets of respective guide ducts toward the spurt holes, the assembling protuberances extending downward from a lower surface of the spurt plate.

6. The clothes washing machine as claimed in claim 5, wherein the outlet portion of each duct is inclined upwardly at an acute angle relative to horizontal, and the guide plates are inclined at equal angles.

7. The clothes washing machine as claimed in claim 1, further including a supplementary blade fixed to the center of the pulsator, the supplementary blade rotating with the pulsator to make a vortex of the water current more violent.

8. The clothes washing machine as claimed in claim 7, wherein the pulsator further comprises a pair of upward flanges arranged at the center region of the pulsator, the flanges being spaced apart from each other to form a gap, a lower rim of the supplementary blade being received in the gap to for assembly with the pulsator.

9. The clothes washing machine as claimed in claim 7, wherein the supplementary blade has a seat arranged at a center of the supplementary blade to receive the spurt cap, the seat having a space formed therein for interconnecting the outlet of the guide duct to the spurt cap.

10. The clothes washing machine as claimed in claim 9, wherein two guide grooves are formed in a cylindrical wall of the space, the spurt cap including downwardly extending plates inserted into respective guide grooves.

11. The clothes washing machine as claimed in claim 9, wherein receiving holes are formed in the seat at locations corresponding to the assembling protuberances of the spurt cap, the assembling protuberances received in respective receiving holes.

12. A clothes washing machine comprising:

a housing;

a spin basket mounted in the housing;

a pulsator rotatably mounted at a bottom of the spin basket for agitating washing water therein; and a washing water spurting apparatus for conducting washing water from beneath the pulsator and spurting the washing water upwardly from a center region of the pulsator, the washing water spurting apparatus comprising at least one guide duct and a spurt cap, the guide duct being fixed to an underside of the pulsator so as to rotate together with the pulsator, the guide duct receiving and guiding washing water introduced toward the center region of the pulsator, the spurt cap being disposed at the center region of the pulsator, so as to upwardly direct the washing water spurting from the guide duct, the guide duct having an inlet formed at a radially outer end of the guide duct and an outlet formed at a radially inner end of the guide duct, the washing water flowing into the guide duct through the inlet and spurting out of the guide duct through the outlet, the inlet of each guide duct facing horizontally, and a radially inner portion of each guide duct being bent upwardly so that the outlet protrudes above the pulsator.

* * * * *